United States Patent [19]

De Luca et al.

[11] 4,097,102

[45] Jun. 27, 1978

[54] TELEPHONE CONNECTOR BLOCK HAVING ELECTRICAL CLIP INTERCONNECTING MEANS

[75] Inventors: Paul V. De Luca, Port Washington; Albert Atun, Valley Stream, both of N.Y.

[73] Assignee: Porta Systems Corp., Syosset, N.Y.

[21] Appl. No.: 808,897

[22] Filed: Jun. 22, 1977

[51] Int. Cl.[2] ..... H01R 7/04; H01R 31/08

[52] U.S. Cl. ..... 339/19; 29/628; 339/97 R

[58] Field of Search ..... 339/19, 97 R, 97 P, 339/98, 99 R, 258 R; 29/628

[56] References Cited

U.S. PATENT DOCUMENTS

| | | | |
|---|---|---|---|
| 2,430,159 | 11/1947 | Chenier | 339/258 R |
| 3,500,292 | 3/1970 | Enright et al. | 339/97 R |
| 3,874,764 | 4/1975 | Volinskie | 339/97 R |

*Primary Examiner*—Neil Abrams

*Attorney, Agent, or Firm*—Charles E. Temko

[57] ABSTRACT

An improved telephone connector block in which the electrically conductive interconnections which have been previously accomplished by wire wrapping of terminals or connector pins are made by means of metallic clips, thereby facilitating the internal wiring of the block, and whereby the ends of conductors forming circuits are connected to a test field. The clips are formed of metallic stampings and include a first portion into which a conductor is resiliently wedged, at a second portion of generally circular configuration which engages a connector pin.

4 Claims, 9 Drawing Figures

FIG. 1
PRIOR ART
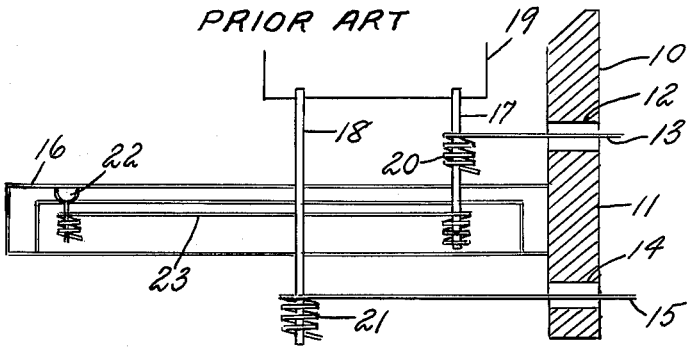
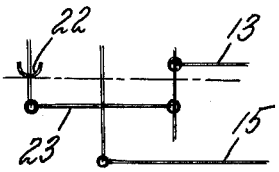
FIG. 2
PRIOR ART
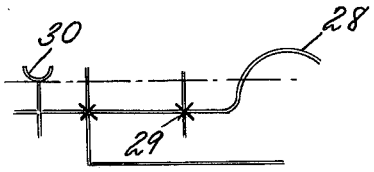
FIG. 3
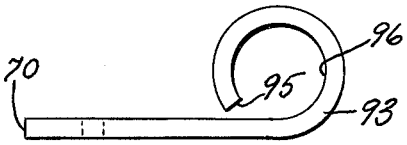
FIG. 8
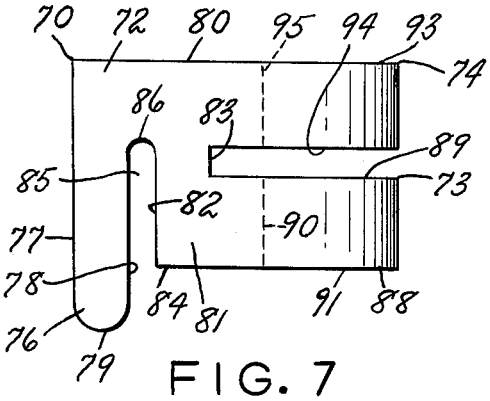
FIG. 7
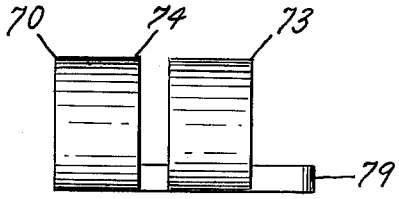
FIG. 9

TELEPHONE CONNECTOR BLOCK HAVING ELECTRICAL CLIP INTERCONNECTING MEANS

BACKGROUND OF THE INVENTION

The manufacture and use of telephone connector blocks in the telephony art has reached a state of very high development. These devices are employed in large numbers in a central telephone office to interconnect subscriber lines to switching equipment located in the office, and are usually mounted upon supporting frame elements in vertical orientation for ready accessibility to service personnel. Such blocks normally include pin terminals for interconnecting individual subscriber lines. The pins are interconnected internally of the block to pins connected to the switching equipment, and to contacts in an adjacent test field, so that individual circuits or groups thereof may be tested for the presence of electrical potential.

The traditional manner of interconnecting pins has been by wire wrapping of a conductor thereabout, which insures firm retention and practically negligible electrical resistance. In recent years, powered wire wrapping tools have been employed to simplify an essentially manual operation. However, because the typical block interconnects hundreds of circuits, the number of wire wrapping operations is large, and the labor expended in completing the internal wiring of an individual block is correspondingly tedious. It is not uncommon for an individual worker to expend several hours internally wiring a single connector block. It should be noted that the wiring operation involves not only the wire wrapping steps, but the cutting and stripping of short lengths of insulated conductors which interconnect pins to test field terminals as well.

SUMMARY OF THE INVENTION

Briefly stated, the invention contemplates the provision of an improved telephone connector block construction in which a substantial number of the usual cutting, stripping and wrapping operations have been eliminated, with a corresponding reduction in the amount of labor which must be expended during the internal wiring thereof. This end is accomplished by the provision of an improved contact clip, a first portion of which clamps and electrically connects with a bared end of a conductor, and a second portion of which is adapted to surround and resiliently clamp a coupling pin. The said first portion engages a first recess in a slotted stud, said stud having a second recess for the accommodation of an insulated conductor at right angles to said first recess. Contact is made with the conductor without the necessity of stripping the insulation therefrom, and the clip itself serves as a replacement for a short length of conductor interconnecting the pin and the insulated conductor. As the first portion is engaged upon the conductor, it cuts the insulation thereof to establish electrical communication, but does not otherwise sever the conductor, so that it may further extend to a remote location, as for example an adjacent test field, where a similar interconnection may be made. As all portions of the clip are engaged simultaneously by moving the same in a common direction, it is possible, using jigging structures, to make a large number of such interconnections simultaneously in a semi-automatic fashion.

BRIEF DESCRIPTION OF THE DRAWINGS

In the drawings, to which reference will be made in the specification, similar reference characters have been employed to designate corresponding parts throughout the several views.

FIG. 1 is a schematic sectional view of a prior art connector block construction, showing conventional circuitry interconnection.

FIG. 2 is a schematic view showing the circuitry interconnection of the structure of FIG. 1.

FIG. 3 is a similar schematic view showing the corresponding circuitry interconnection in accordance with the disclosed invention.

FIG. 7 is an enlarged side elevational view of a contact clip forming a part of the disclosed embodiment.

FIG. 8 is a top plan view of the clip.

FIG. 9 is an elevational view of the clip as seen from the right hand portion of FIG. 8.

DETAILED DESCRIPTION OF THE DISCLOSED EMBODIMENT

Figure 4:
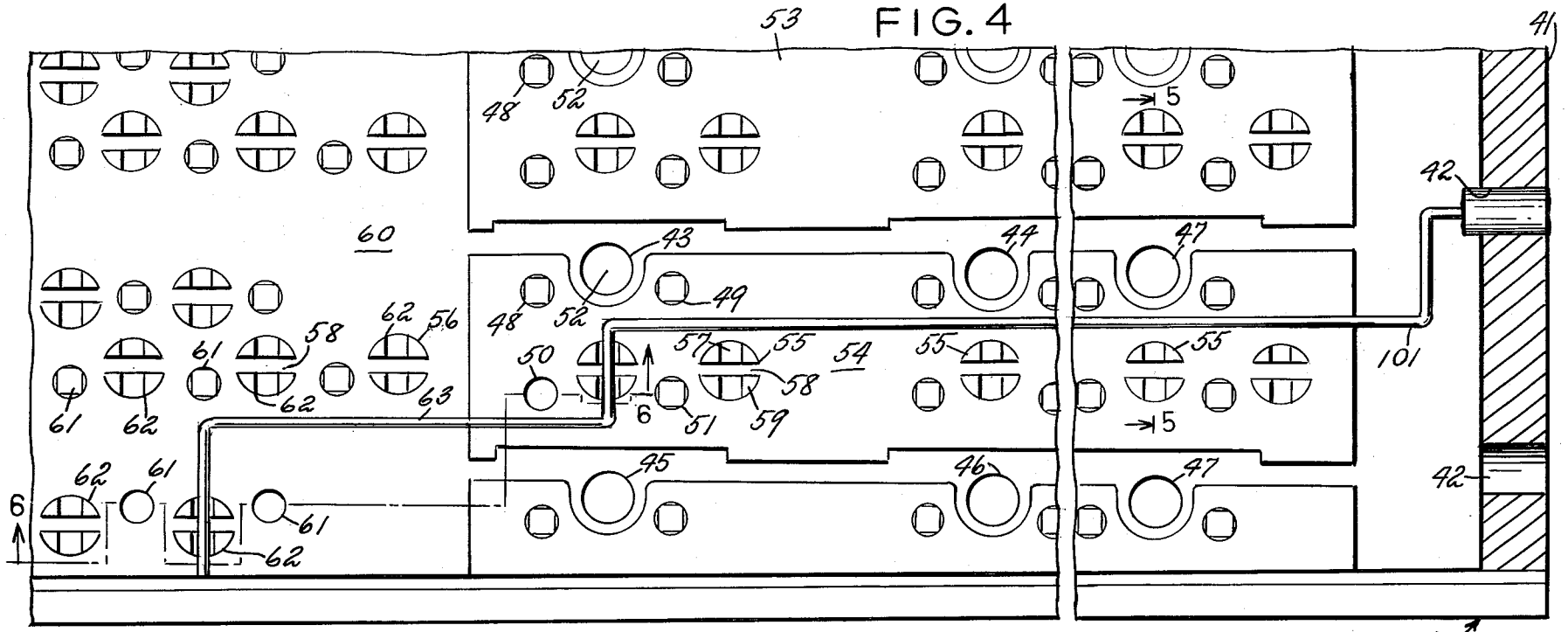
FIG. 4 is a fragmentary view in elevation of a connector block embodying the invention.
Figure 5:
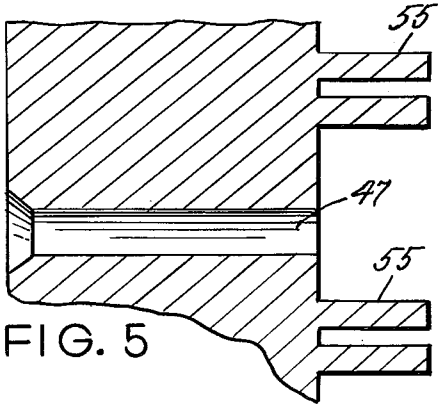
FIG. 5 is a fragmentary sectional view as seen from the plane 5—5 in FIG. 4.

With reference to the accompanying drawings, FIG. 1 schematically illustrates a portion of a prior art connector block, generally indicated by reference character 10. The block includes a side wall 11 having an opening 12 penetrated by a cable 13 communicating with subscriber circuits, and an opening 14 communicating with a cable 15 interconnected with internal switching means (not shown) as is well known in the art. The side wall 11 communicates with a main wall 16 penetrated by a plurality of connecting pins 17 and 18 which are engaged by an interconnecting plug 19, interconnection of which establishes communication between an individual subscriber line and the internal switching means. The cable 13 is interconnected by a wrap 20 around the pin 17, and the cable 15 is interconnected by a similar wrap 21. A test field contact 22 interconnects through conductor 23 with the pin 17. It will be understood that each circuit requires two similar structures, only one of which is illustrated. It will be observed that the structure illustrated in FIG. 1 requires three wire wrapping operations exclusive of the test field contact wire wrap. This is schematically illustrated in FIG. 2.

Referring to FIG. 3, there is schematically illustrated a replacement structure embodying the invention, in which an outside conductor 28 is clipped to a pin 29 and to a test contact 30 by means of a structure described hereinbelow to accomplish an equivalent result, and eliminate all three wire wrap operations. A similar clipping operation (not shown) replaces the wire wrap 21 in FIG. 1. Further, with the elimination of the wire wrapping operations, the clips permit the same conductor to be extended to the test field, without the necessity of cutting and attaching a separate conductor interconnecting the pin 17 to the test field contact 22, as in the prior art.

With the foregoing aspect in view, reference may now be had to FIG. 4, wherein a connector block 40 embodying the invention is illustrated. The block includes a side wall 41 having conductor inlet openings 42, and a plurality of circuit terminal areas generally indicated by reference characters 43, 44, 45, 46 and 47. It will be understood that the typical circuit connector block often includes many hundreds of such areas, all of which are substantially similar. Each circuit terminal area includes the usual four pins 48, 49, 50 and 51, usually referred to in the art as "tip in", "tip out", "ring in" and "ring out". A grounding prong opening 52 accommodates the grounding prong of a connecting plug (not shown).

Supported on the inner surface 54 of the main wall 53 are a plurality of cylindrically shaped studs or projections, 55, each bounded by an outer cylindrical surface 56 and having a first longitudinal slot 57 and a second longitudinal slot 58, the plane of which is at right angles to the slot 57. Both slots are accessible from an outer end surface 59.

Referring to the left hand portion of FIG. 4, a test field area 60 includes a plurality of test pins 61 adjacent a second plurality of projections 62 for accommodating pluralities of conductors 63 which communicate with terminals 48–51 on the wall 53.

Referring to FIGS. 7 to 9, inclusive, a plurality of metallic conductor clips 70, formed from flat stampings, are used to interconnect conductors supported by the projections 55 and 62 to adjacent pins 48–51, and test pins 61. Each clip includes a generally U-shaped conductor-engaging member 72 and first and second pin engaging members 73 and 74, respectively.

The conductor engaging member 72 includes a first elongated portion 76 bounded by an outer edge 77, an inner edge 78 and end edges 79 and 80. A second elongated portion 81 is bounded by an inner edge 82, and outer edge 83, an end edge 84 and the above-mentioned edge 80. An elongated slot 85 is open at its outer end, and terminates in a curved end edge 86.

The first pin engaging member 73 is of circular configuration, and is bounded by an outer edge 88, an inner edge 89 and an end edge 90. It defines an opening of diameter adapted to loosely fit over a pin. The second pin engaging member 74 is coaxially aligned therewith, and is bounded by an outer edge 93, an inner edge 94 and an end edge 95. The opening 96 is 0.005 inches smaller than the opening 91 in the first pin engaging member, so that when the clip is installed, the first member may serve as an aligning guide for the second which forms a light force fit.

Figure 6:
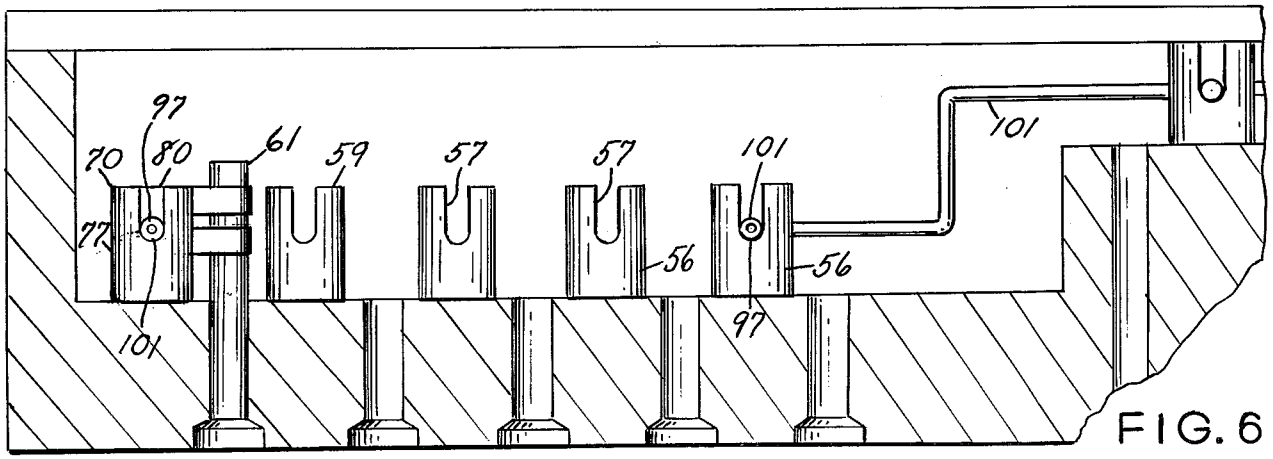
FIG. 6 is a fragmentary sectional view as seen from the plane 6—6 in FIG. 4.

FIG. 6 shows the installation of the clips for the interconnection of a terminal pin with a flexible conductor. A conductor 97 in the form of an insulated wire is positioned in a first slot 57, and the clip is placed in straddling condition thereover by engaging the second slot 58. As the width of the slot in the clip is substantially equal to the diameter of the conductive wire, with installation, it cuts the insulative cover 101 and establishes electrical communication. With this engagement, the conductor engaging members 72 and 74 firmly engage the adjacent pin, and maintain the clips in position as shown.

It will be apparent that each clip is installed in a substantially similar manner, permitting, where desired, the positioning of a plurality of clips in a fixture which is lowered under pressure to simultaneously install a large number of clips at one time, it being necessary only to position the conductors in proper location prior to positioning the clips. Thus, the internal wiring of the connector block may be manually completed employing only a small fraction of the time required with conventional wiring wrap operations.

We wish it to be understood that we do not consider the invention limited to the precise details of structure shown and set forth in this specification, for obvious modifications will occur to those skilled in the art to which the invention pertains.

We claim:

1. In an electrical connector block structure including a wall, a plurality of coupling pins penetrating said wall, and conductor means interconnecting certain of said pins for electrical communication therebetween, the improvement comprising: a plurality of projections carried by a surface of said wall and disposed adjacent said coupling pins, said projections extending laterally from said surface; said projections having first and second axially arranged slots, portions of which intersect at an angle; a plurality of clip elements, each having a first member of generally planar configuration, the thickness of which corresponds to the width of a first slot in said projections, said first member defining an elongated slot in the plane thereof, the width of which corresponds to the diameter of said conductor means; said plurality of clip elements having a second member of generally circular configuration, the internal diameter of which corresponds to the effective width of said coupling pins; said conductor means being positioned in said second slots of said projections, and maintained thereby by the engagement of a first member of a clip element in said first slots, whereby said slots in said first members straddle the conductor to establish electrical communication; said second member of said clips surrounding adjacent pins in clamping relation to thereby establish a path of conduction between said conductors and said pins.

2. Structure in accordance with claim 1, further characterized in the provision of a pair of second members comprising said clip, of slightly differing internal diameter, whereby one of said second members may serve as a guide to facilitate engagement of the other of said second members upon a pin, said other of said second members serving a clamping function.

3. Structure in accordance with claim 1, further characterized in said conductor means including a wire having an insulative cover, the width of said slot in said first member of said clip being such as to cut said cover and establish electrical communication with said wire.

4. In a combination electrically conductive elongated pin and a flexible electrical conductor in interconnected relation thereto, the improvement comprising: improved clip means interconnecting said pin and said conductor, said clip including a first member of generally planar configuration and having an elongated slot in the plane thereof, the width of which corresponds to the diameter of said conductor means, said clip having a second member including first and second discreet circular portions in mutually spaced relation, a first portion of which is of internal diameter slightly greater than the internal diameter of said second portion, the diameter of said second portion corresponding to the effective width of said pin, whereby said first portion may serve as an alignment guide upon the engagement with said pin, and said second portion may serve a clamping function, the conductor receiving mouth of said slot and the pin entrance opening in said first portion facing in the same direction.

* * * * *